US008239117B2

(12) United States Patent
Rieder et al.

(10) Patent No.: US 8,239,117 B2
(45) **Date of Patent: *Aug. 7, 2012**

(54) METHOD AND DEVICE FOR OPERATING AN INTERNAL COMBUSTION ENGINE

(75) Inventors: Gerald Rieder, Freising (DE); Paul Rodatz, Landshut (DE)

(73) Assignees: Continental Automotive GmbH, Hannover (DE); Audi AG, Ingolstadt (DE)

( * ) Notice: Subject to any disclaimer, the term of this patent is extended or adjusted under 35 U.S.C. 154(b) by 777 days.

This patent is subject to a terminal disclaimer.

(21) Appl. No.: 12/369,111

(22) Filed: Feb. 11, 2009

(65) Prior Publication Data

US 2009/0210136 A1 Aug. 20, 2009

(30) Foreign Application Priority Data

Feb. 14, 2008 (DE) ..... 10 2008 009 034

(51) Int. Cl.
*F02D 41/14* (2006.01)
*F02D 41/30* (2006.01)

(52) U.S. Cl. ..... 701/103; 123/672

(58) Field of Classification Search ..... 701/103–105, 701/102, 109, 113, 111; 123/676, 672, 697; 60/285
See application file for complete search history.

(56) References Cited

U.S. PATENT DOCUMENTS 4,765,300 A 8/1988 Fujimura et al. ..... 123/491
5,638,800 A 6/1997 Furuya et al. ..... 123/674
5,817,923 A 10/1998 Ohsaki et al. ..... 73/35.02
6,951,205 B2 10/2005 Joos et al. ..... 123/491
7,191,771 B2 3/2007 Ketterer et al. ..... 123/674
7,284,545 B2 * 10/2007 Rosel et al. ..... 123/673
7,835,849 B2 * 11/2010 Rieder et al. ..... 701/103
(Continued)

FOREIGN PATENT DOCUMENTS

DE 19545924 A1 6/1996
(Continued)

OTHER PUBLICATIONS

Basshuysen, Richard, et al., "Handbuch Verbrennungsmotor", Vieweg & Sohn Verlagsgesellschaft mbH, 2nd edition, pp. 559-561, Jun. 2002.

*Primary Examiner* — Hieu T Vo
(74) *Attorney, Agent, or Firm* — King & Spalding L.L.P.

(57) ABSTRACT

A start quantity adaptation value (ST_AD) is adapted as a function of a variable that is characteristic of a rotational speed profile during the start (ST) of the internal combustion engine. A lambda adaptation value (LAM_AD) is adapted as a function of at least one control parameter (LAM_RP) of the lambda controller if a preset condition (COND) is met, which presupposes the existence of a quasi-stationary operating state. An intermediate correction value (ZW_KOR) is adapted as a function of a change of the start quantity adaptation value (ST_AD) since a last adaptation of the lambda adaptation value (LAM_AD). A fuel mass (MFF) to be metered is determined as a function of at least one operating variable (BG) of the internal combustion engine. The fuel mass (MFF) to be metered is corrected during the start (ST) of the internal combustion engine by means of the start quantity adaptation value (ST_AD). The fuel mass (MFF) to be metered outside of the start (ST) of the internal combustion engine is corrected as a function of the lambda adaptation value (LAM_AD). The fuel mass (MFF) to be metered is corrected as a function of the intermediate correction value (ZW_KOR) until for the first time after the respective start (ST) the lambda adaptation value (LAM_AD) is adapted.

6 Claims, 5 Drawing Sheets

U.S. PATENT DOCUMENTS

| | | | | |
|---|---|---|---|---|
| 8,027,779 | B2 * | 9/2011 | Rieder et al. | 701/109 |
| 2008/0201057 | A1 | 8/2008 | Aliakbarzadeh et al. | 701/103 |
| 2009/0210130 | A1 | 8/2009 | Rieder et al. | 701/102 |

FOREIGN PATENT DOCUMENTS

| | | | |
|---|---|---|---|
| DE | 19702556 | A1 | 7/1997 |
| DE | 10221337 | A1 | 11/2003 |
| DE | 10252423 | A1 | 5/2004 |
| DE | 10307004 | B3 | 8/2004 |
| DE | 102005009101 | B3 | 3/2006 |
| DE | 102006043702 | B3 | 7/2007 |
| DE | 102007028380 | A1 | 1/2008 |

* cited by examiner

METHOD AND DEVICE FOR OPERATING AN INTERNAL COMBUSTION ENGINE

CROSS-REFERENCE TO RELATED APPLICATIONS

This application claims priority to DE Patent Application No. 10 2008 009 034.4 filed Feb. 14, 2008, the contents of which is incorporated herein by reference in its entirety.

TECHNICAL FIELD

The underlying object of the invention is to provide a method and a device for operating an internal combustion engine.

BACKGROUND

Increasingly stringent statutory regulations regarding allowable emissions of noxious substances from motor vehicles, in which internal combustion engines are disposed, make it necessary to keep emissions of noxious substances during operation of the internal combustion engine as low as possible. This may be done, on the one hand, by reducing the emissions of noxious substances that arise during burning of the air-fuel mixture in the respective cylinder of the internal combustion engine. On the other hand, for internal combustion engines exhaust treatment systems are used, by means of which the emissions of noxious substances generated during the process of burning the air-fuel mixture in the respective cylinders are converted into harmless substances. For this purpose catalytic converters are used, which convert carbon monoxide, hydrocarbons and nitrous oxides into harmless substances. Both purposeful influencing of the production of noxious substance emissions during combustion and highly efficient conversion of the noxious components by means of a catalytic converter presuppose a very precisely adjusted air-fuel mixture in the respective cylinder.

From the textbook "Internal Combustion Engine Manual", published by Richard von Basshuysen, Fred Schafer, second edition, Vieweg & Sohn Verlaggesellschaft mbH, June 2002, pp. 559 to 561, a linear lambda controller is known, comprising a linear lambda probe, which is disposed upstream of a catalytic converter, and a binary lambda probe, which is disposed downstream of the catalytic converter. A lambda setpoint value is filtered by means of a filter that takes into account delays in exhaust gas analysis and the sensor response. The lambda setpoint value thus filtered is the controlled variable of a $PI^2D$ lambda controller, the manipulated variable of which is an injection quantity correction.

Furthermore, from the same pages of the same textbook a binary lambda controller is also known, comprising a binary lambda probe, which is disposed upstream of the catalytic converter. The binary lambda controller comprises a PI controller, the P- and I components being stored in engine speed- and load characteristic maps. In the case of the binary lambda controller, the excitation of the catalytic converter, also described as lambda fluctuation, arises implicitly as a result of the two-step control. The amplitude of the lambda fluctuation is set to approximately 3%.

DE 19702556 A1 discloses a device for detecting the fuel properties for an internal combustion engine, which device detects the property of the fuel used by the engine from the operating state during the start of the engine and emits a signal that indicates the detected fuel property. The property of the fuel used is determined on the basis of a parameter representing the starting performance of the internal combustion engine and a parameter representing the revolution change during the start.

The underlying object of the invention is to provide a method and a device for operating an internal combustion engine, which are simple and also precise.

The object is achieved by the features of the independent claims. Advantageous embodiments of the invention are characterized in the subclaims.

An embodiment of the invention is notable for a method and a device for operating an internal combustion engine comprising at least one cylinder with a combustion chamber, an injection valve that is provided for metering fuel, a lambda controller being provided. A start quantity adaptation value is adapted as a function of a variable that is characteristic of a rotational speed profile during a respective start of the internal combustion engine. A lambda adaptation value is adapted as a function of at least one control parameter of the lambda controller if a preset condition is met, which presupposes the existence of a quasi-stationary operating state. An intermediate correction value is adapted as a function of a change of the start quantity adaptation value since a last adaptation of the lambda adaptation value. A fuel mass to be metered is determined as a function of at least one operating variable of the internal combustion engine. The fuel mass to be metered during the start of the internal combustion engine is corrected by means of the start quantity adaptation value. The fuel mass to be metered is corrected outside of the start of the internal combustion engine as a function of the lambda adaptation value. The fuel mass to be metered is corrected as a function of the intermediate correction value until for the first time after the respective start the lambda adaptation value is adapted. In this way it is possible, particularly after the respective start up to the first adaptation of the lambda adaptation value to occur after the respective start, to realize precise control of the internal combustion engine and hence, on the one hand, keep down the production of undesirable noxious substance emissions and, on the other hand, also guarantee smooth running of the internal combustion engine. For the metering of the corrected fuel mass to be metered, in particular an actuating signal for the injection valve is generated.

In this way, knowledge of the change of the start quantity adaptation value since the last adaptation of the lambda adaptation value makes it possible to estimate the adaptation requirement for determining the fuel mass to be metered also outside of the start of the internal combustion engine, before finally a precise adaptation of the lambda adaptation value is possible by means of the at least one control parameter of the lambda controller. Thus, in this intermediate period a very precise control of the internal combustion engine may occur. In particular, after the first adaptation of the lambda adaptation value to occur after the respective start the intermediate correction value may be set to a neutral value.

According to an advantageous embodiment, the adapting of the intermediate adaptation value is carried out in such a way that a variation of the start quantity adaptation value has a relatively smaller effect upon a variation of the intermediate correction value. Thus, effects caused by a rising temperature of the internal combustion engine and in particular of its coolant as an increasing amount of time passes after the start of the internal combustion engine, as well as an overcoming of the inertia of the internal combustion engine that occurs already during the start may advantageously be taken into account and hence, after the start and before the first adaptation of the lambda adaptation value to occur after the start, a particularly precise metering of the fuel, namely particularly in respect of an air-fuel ratio to be adjusted, may be realized.

According to a further advantageous embodiment, the adapting of the intermediate correction value is carried out only if the change of the start quantity adaptation value since the last adaptation of the lambda adaptation value exceeds a predetermined threshold value. An unnecessary adaptation of the intermediate adaptation value may therefore be avoided, with a sufficiently precise correction by means of the lambda adaptation value.

According to a further advantageous embodiment, with the expiry of a preset period and/or the attainment of a preset temperature, in particular a coolant temperature, after the respective start the correcting with the intermediate correction value is returned by means of a ramp function over time to a neutral value. In this way it is possible to achieve a particularly gentle transition and hence guarantee a continuously precisely adjusted air-fuel ratio particularly well.

According to a further advantageous embodiment, the preset condition is dependent upon a rotational speed and/or a load variable. In this way, the adapting of the lambda adaptation value may be realized particularly effectively in terms of a precise determination of the corrected air-fuel mass to be metered in respect of a precisely adjusted air-fuel mixture.

BRIEF DESCRIPTION OF THE DRAWINGS

There now follows a detailed description of exemplary embodiments of the invention with reference to the schematic drawings. These show.

In all of the figures, elements of an identical design or function are denoted by the same reference characters.

DETAILED DESCRIPTION

Figure 1:
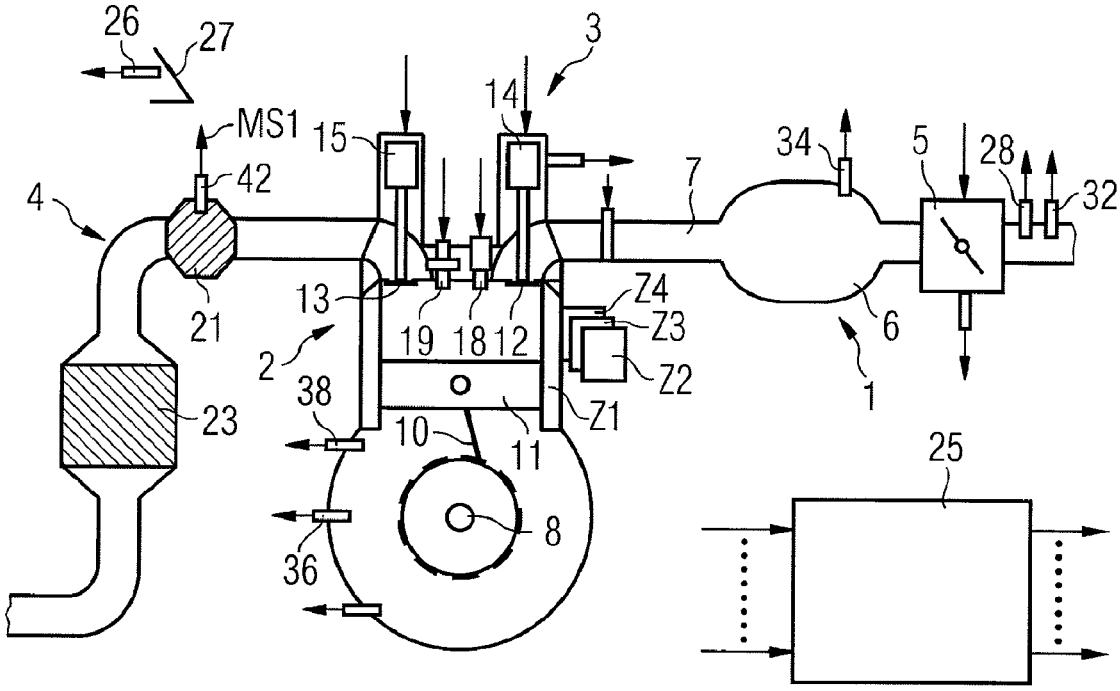
FIG. 1 an internal combustion engine with a control device.

An internal combustion engine (FIG. 1) comprises an intake tract 1, an engine block 2, a cylinder head 3 and an exhaust tract 4. The intake tract 1 preferably comprises a throttle valve 5, as well as a collector 6 and an intake manifold 7 that extends in the direction of a cylinder Z1 through an inlet channel into the engine block 2. The engine block 2 further comprises a crankshaft 8, which is connected by a connecting rod 10 to the piston 11 of the cylinder Z1.

The cylinder head 3 comprises a valve operating mechanism having a gas inlet valve 12 and a gas outlet valve 13.

The cylinder head 3 further comprises an injection valve 18 and a spark plug 19. Alternatively, the injection valve 18 may be disposed in the intake manifold 7.

Disposed in the exhaust tract is a catalytic converter in the form of a three-way catalytic converter 21. A further catalytic converter is moreover preferably disposed in the exhaust tract and is embodied as a NOx catalytic converter 23.

A control device 25 is provided, with which are associated sensors that detect various measured quantities and determine in each case the value of the measured variable. The control device 25 determines, as a function of at least one of the measured quantities, manipulated variables, which are then converted into one or more actuating signals for controlling the final controlling elements by means of corresponding final control element operators. The control device 25 may also be described as a device for controlling the internal combustion engine.

The sensors are a pedal position sensor 26 that detects an accelerator pedal position of an accelerator pedal 27, an air-flow sensor 28 that detects an air flow upstream of the throttle valve 5, a first temperature sensor 32 that detects an intake air temperature, an intake manifold pressure sensor 34 that detects an intake manifold pressure in the collector 6, a crankshaft angle sensor 36 that detects a crankshaft angle, to which a rotational speed N is then assigned.

An exhaust-gas probe 42 is further provided, which is disposed upstream of a three-way catalytic converter 42 or in the three-way catalytic converter 42 and detects a residual oxygen content of the exhaust gas and of which the measurement signal MS1 is characteristic of the air-fuel ratio in the combustion chamber of the cylinder Z1 and upstream of the first exhaust-gas probe prior to oxidation of the fuel, hereinafter referred to as the air-fuel ratio in the cylinders Z1 to Z4.

The exhaust-gas probe 42 may be a linear lambda probe or a binary lambda probe.

Depending on the embodiment of the invention any desired subset of the described sensors may be provided or, alternatively, additional sensors may be provided.

The final controlling elements are for example the throttle valve 5, the gas inlet- and gas outlet valves 12, 13, the injection valve 18 or the spark plug 19.

In addition to the cylinder Z1 further cylinders Z2-Z4 are preferably also provided, with which corresponding final controlling elements and optionally sensors are also associated.

Figure 2:
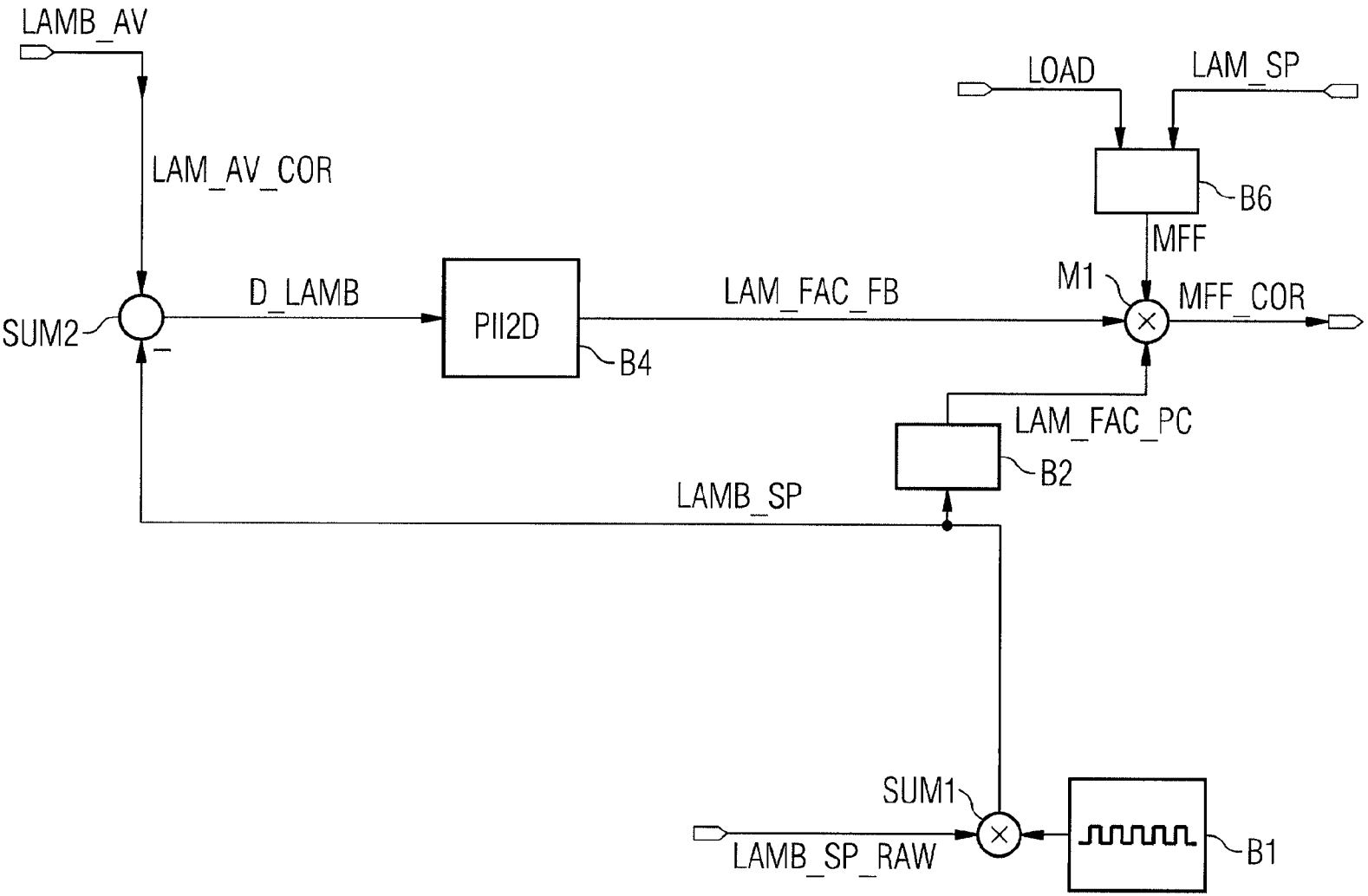
FIG. 2 a block diagram of part of the control device of the internal combustion engine in a first embodiment, FIG. 3 a further block diagram of part of the control device of the internal combustion engine according to a second embodiment, FIG. 4 a time characteristic of a lambda control factor, FIG. 5 a first sequence diagram for operating the internal combustion engine, and FIG. 6 a second sequence diagram for operating the internal combustion engine.

A block diagram of part of the control device 25 according to a first embodiment is represented in FIG. 2. In a particularly simple embodiment, a preset raw air/fuel ratio LAMB_SP_RAW may be established. It is however preferably determined for example as a function of the current operating mode of the internal combustion engine, such as homogeneous or shift operation and/or as a function of operating variables of the internal combustion engine. In particular, the preset raw air-fuel ratio LAMB_SP_RAW may be defined as, say, the stoichiometric air-fuel ratio. Operating variables comprise measured quantities and quantities derived therefrom.

In a block B1 a positive excitation is determined and in the first summing point SUM1 is summed with the preset raw air-fuel ratio LAMB_SP_RAW. The positive excitation is a square wave signal. The output variable of the summing point is then a predetermined air-fuel ratio LAMB_SP in the combustion chambers of the cylinders Z1 to Z4. The predetermined air-fuel ratio LAMB_SP is supplied to a block B2, which contains a feedforward control and generates a lambda feedforward control factor LAMB_FAC_PC as a function of the predetermined air-fuel ratio LAMB_SP.

In a second summing point SUM2, as a function of the predetermined fuel-air ratio LAMB_SP and the acquired air-fuel ratio LAMB_AV by subtraction a control deviation D_LAMB is determined, which is the input variable into a block B4. In the block B4 a linear lambda controller is embodied, namely preferably in the form of a $PII^2D$ controller. The manipulated variable of the linear lambda controller of the block B4 is a lambda control factor LAM_FAC_FB.

The predetermined air-fuel ratio LAMB_SP may also be subjected to filtering prior to the subtraction in the summing point S2.

A block B6 is further provided, in which as a function of a load LOAD, which may be for example an air flow, a fuel mass MFF to be metered is determined. In a correction block M1 a corrected fuel mass to be metered is determined for example by obtaining the product of the fuel mass MFF to be metered, the lambda feedforward control factor LAM_N-FAC_PC and the lambda control factor LAM_NFAC_FB.

Depending on the embodiment, it is also possible for example to determine a correction factor as a function of a sum of the lambda feedforward control factor LAM_N-FAC_PC, the lambda control factor LAM_FAC_FB and also one or more further values, such as a lambda adaptation value LAM_AD, and then combine it multiplicatively with the fuel mass MFF to be metered. The corrected fuel mass MFF_COR to be metered that is determined in the correction block M1 is then converted into an actuating signal SG for triggering the injection valve 18.

Figure 3:
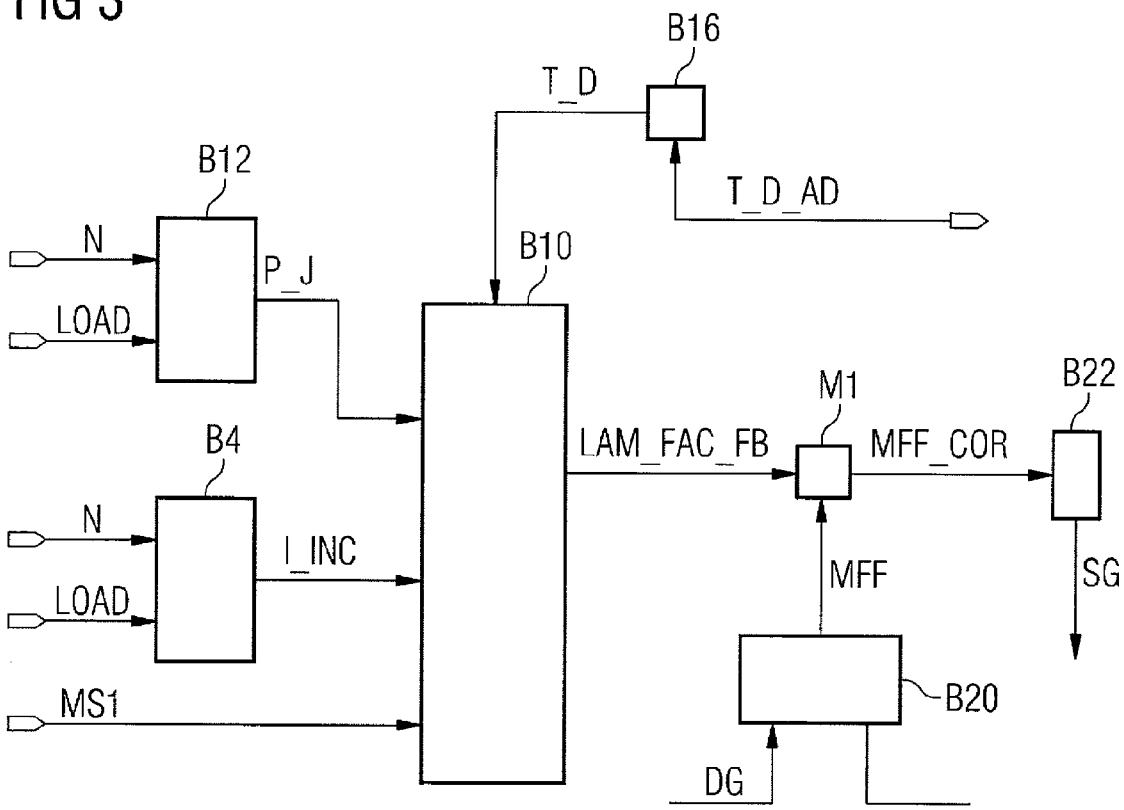

Part of the control device 25 in a further embodiment with a binary lambda controller is described in detail with reference to the block diagram of FIG. 3.

A block B10 comprises a binary lambda controller. The measurement signal MS1 is supplied as a controlled variable to the binary lambda controller. In this connection, the exhaust-gas probe 42 is embodied as a binary lambda probe and the measurement signal is therefore of a substantially binary nature, i.e. it assumes a lean value, when the air-fuel ratio upstream of the catalytic converter 21 is lean, and a rich value, when said ratio is rich. It is only in a very small intermediate range, i.e. for example in the case of an exactly stoichiometric air-fuel ratio, that it also assumes intermediate values between the lean value and the rich value. Because of the binary nature of such a measurement signal MS1, the binary lambda controller is embodied as a two-step controller. The binary lambda controller is preferably embodied as a PI controller. A P component is preferably supplied as proportional step change P_J to the block 10.

A block B12 is provided, in which as a function of the rotational speed N and the load LOAD the proportional step change P_J is determined. For this purpose, a characteristics map is preferably provided, which may be permanently stored.

An I component of the binary lambda controller is preferably determined as a function of an integral increment I_INC. The integral increment I_INC is preferably determined in a block B14 also as a function of the rotational speed N and the load LOAD. For this purpose, it is likewise possible for example to provide a characteristics map. The load LOAD may be for example the air flow or alternatively for example the intake manifold pressure.

Figure 4:
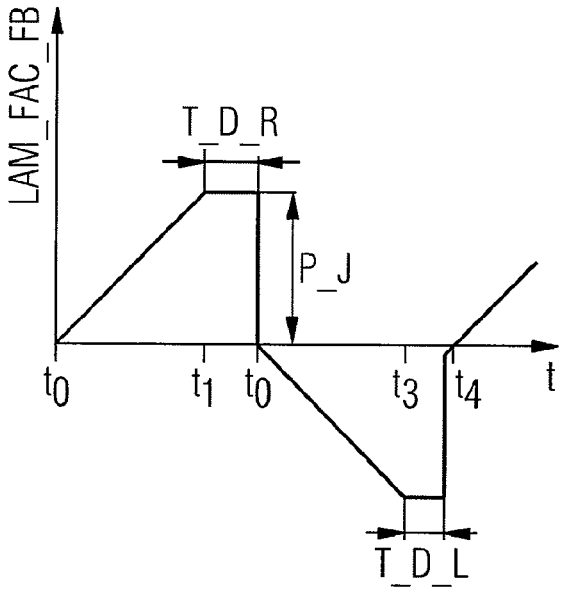

Furthermore, there is also supplied to the block B10 as an input parameter a time delay TD that is determined in a block B16, namely preferably as a function of a correction value K that is described in detail with reference to FIG. 7. At the output side of the binary lambda controller the lambda control factor LAM_FAC_FB is present. A block B20 corresponds to the block B6. In a block B22 an actuating signal SG for the respective injection valve 18 is generated as a function of the corrected fuel mass MFF_COR to be metered. The mode of operation of the binary lambda controller is described in detail by way of example with reference to FIG. 4. At a time t0 the lambda control factor LAM_NFAC_FB has a neutral value, for example 1, and from the time t0 to a time t1 is increased as a function of the integral increment I_INC, namely up to a time t1. This occurs, for example, in a predetermined time frame, in which in each case the current value of the lambda control factor LAM_FAC_FB and the integral increment I_INC is increased. The time t1 is characterized by the first measurement signal MS1 changing from its lean value to its rich valve.

If it is recognized that the first measurement signal MS1 has changed from its lean value to the rich value, then the lambda control factor LAM_NFAC_FB is incremented no further by the integral increment I_INC, its value instead being maintained for the time delay T_D, namely, in the event of a change towards rich having occurred, for the rich proportional step change time delay T_D_R and, in the event of a change towards lean, for the lean proportional step change time delay T_D_L. With expiry of the time delay T_D, which is the case for example at a time t2, the lambda control factor LAM_NFAC_FB is reduced in accordance with the proportional step change P_J. After the step change of the lambda control factor LAM_NFAC_FB at the time t2, the lambda control factor LAM_NFAC_FB is then reduced in accordance with the integral increment I_INC until the measurement signal MS1 undergoes a step change from the rich value to the lean value, which is the case at the time t3. From the time t3, the lambda control factor LAM_FAC_FB maintains its value for the predetermined lean proportional step change time delay T_D_L before it is then, with expiry of the lean proportional step change time delay T_D_L at a time t4, increased again by the proportional step change P_J and then a fresh control period begins.

Figure 5:
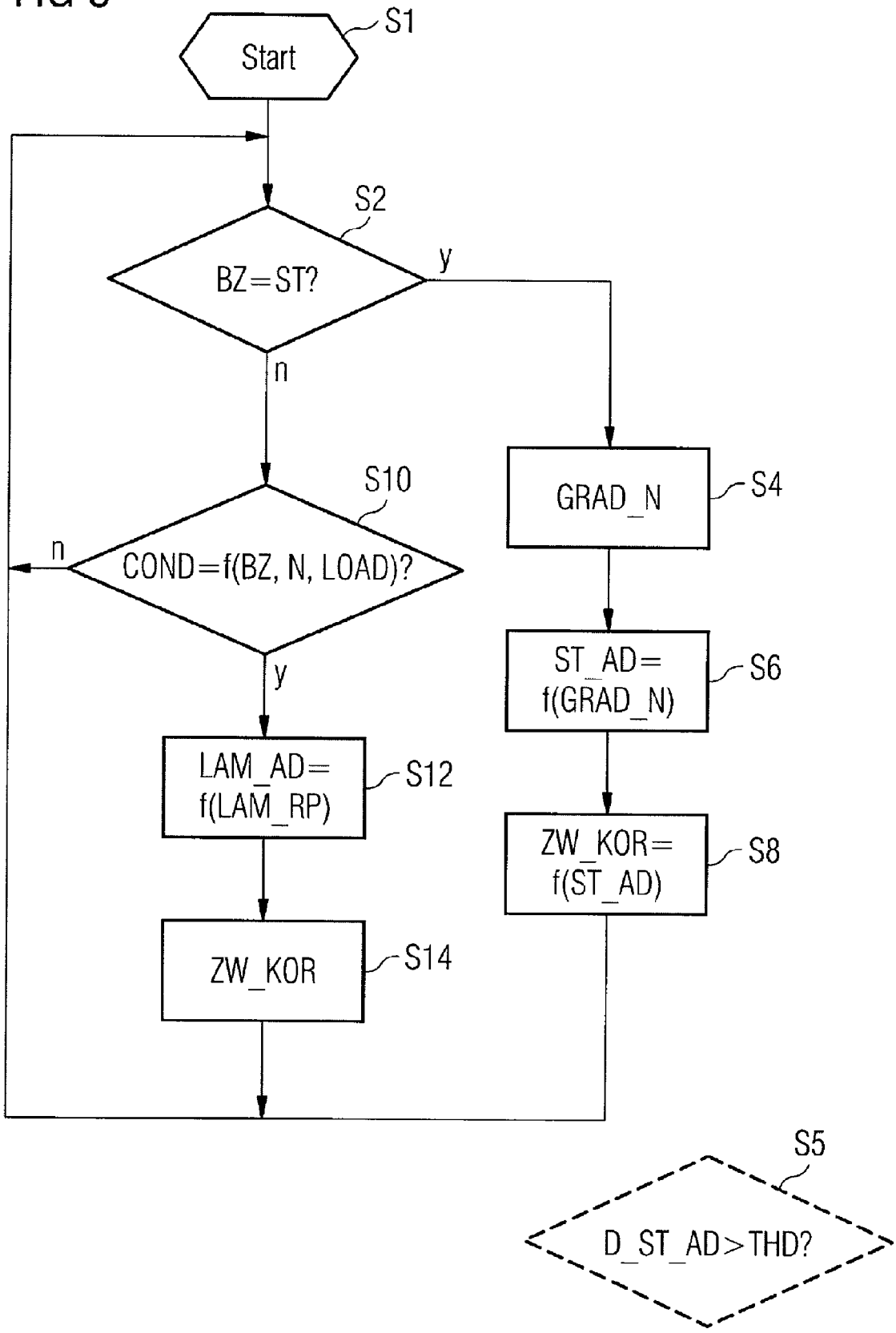

There now follows a detailed description with reference to the sequence diagram of FIG. 5 of a program that is executed during operation of the internal combustion engine and is started in a step S1. The program is fundamentally suitable for use in connection with the first embodiment of the control device but also in connection with the second embodiment of the control device 25, given optionally appropriate adaptation of the steps.

The program is preferably started, say, at the latest with the start ST of the internal combustion engine and in the step S1 for example variables may be initialized.

In a step S2 it is checked whether the internal combustion engine is in an operating state BZ of the start ST. The operating state of the start is characterized for example by the rotational speed N not yet having reached a predetermined rotational speed value, which may be for example approximately 400 revolutions per minute. If the condition of step S2 is met, the execution is continued in a step S4, in which a variable that is characteristic of a rotational speed profile during the start ST of the internal combustion engine is determined. For this purpose, for example a rotational speed gradient GRAD_N is determined. In this connection, in an embodiment the program may remain in the step S4 substantially for the entire duration of the operating state BZ of the start ST.

In a step S6 a start quantity adaptation value ST_AD is adapted as a function of the variable that is characteristic of the rotational speed profile during the start of the internal combustion engine, i.e. in particular of the rotational speed gradient GRAD_N. The adapting of the start quantity adaptation value ST_AD in the step S6 may be effected for example while simultaneously taking into account a reference rotational speed gradient, which can be predetermined or may correspond to the rotational speed gradient GRAD_N determined the last time the program was executed. Thus, for example in step S6 depending on a degree of deviation between the reference rotational speed gradient and the rotational speed gradient GRAD_N, a corresponding variation of the start quantity adaptation value ST_AD may result, in the simplest case purely proportionally to the determined deviation. In this case, it is however naturally possible to use any desired functional correlation.

In a step S8 an intermediate correction value ZW_KOR is then adapted as a function of the change of the start quantity adaptation value ST_AD since the last adaptation of a lambda adaptation value LAM_AD. In this case, for example a variation of the start quantity adaptation value ST_AD since the last adaptation of the lambda adaptation value LAM_AD may be converted to an identical or varied extent to an adaptation of the intermediate correction value ZW_KOR. Preferably, however, the intermediate correction value ZW_KOR is adapted in such a way that a variation of the start quantity adaptation value ST_AD has a relatively smaller effect upon a variation of the intermediate correction value ZW_KOR. It is thereby easily possible to take into account an increased temperature of the internal combustion engine compared to the start ST, i.e. for example of a coolant associated therewith, and/or also an overcoming of a moment of inertia of the internal combustion engine that occurs after the start.

The execution is then continued afresh, optionally after a definable time delay or a definable crankshaft angle, in the step S2.

If the condition of the step S2 is not met, then in a step S10 it is checked whether a preset condition COND is met, which presupposes as operating state BZ a quasi-stationary operating state and which may for example additionally depend upon a rotational speed and/or a load variable LOAD, wherein for example for meeting the condition COND it may be necessary for the rotational speed N to be in a specific rotational speed range and for the load variable LOAD also to be in a specific predetermined range or for these quantities to vary only by a predetermined low value for a definable period of time. The quasi-stationary state is in particular characterized by the rotational speed N changing only slightly to substantially not at all and/or by the same applying also to the load variable LOAD.

If the condition of the step S10 is met, then in a step S12 the lambda adaptation value LAM_AD is adapted as a function of a lambda control parameter LAM_RP. This may for example comprise the assignment of a predetermined component of the value—varying from a neutral value—of the lambda control parameter LAM_NRP to the lambda adaptation value LAM_AD. In a particularly preferred manner, the lambda control parameter LAM_RP is for example an integral component of the respective associated lambda controller, hence for example of the binary lambda controller or of the linear lambda controller.

In a step S14 the intermediate correction value ZW_KOR is reset to its neutral value, which for example in the event of a formation of the intermediate correction value as a correction factor may have the value 1.

The execution is then continued afresh in the step S2 in accordance with the procedure according to the step S8. Before step S6 a step S5 may optionally be provided, in which it is checked whether a variation D_ST_AD of the start quantity adaptation value ST_AD is greater than a preset threshold value THD, the variation preferably being related to the last adaptation of the lambda adaptation value LAM_AD. It is only if the condition of the step S5 is met that in this case the execution is then continued in the step S6, otherwise the execution continues in the step S2.

Figure 6:
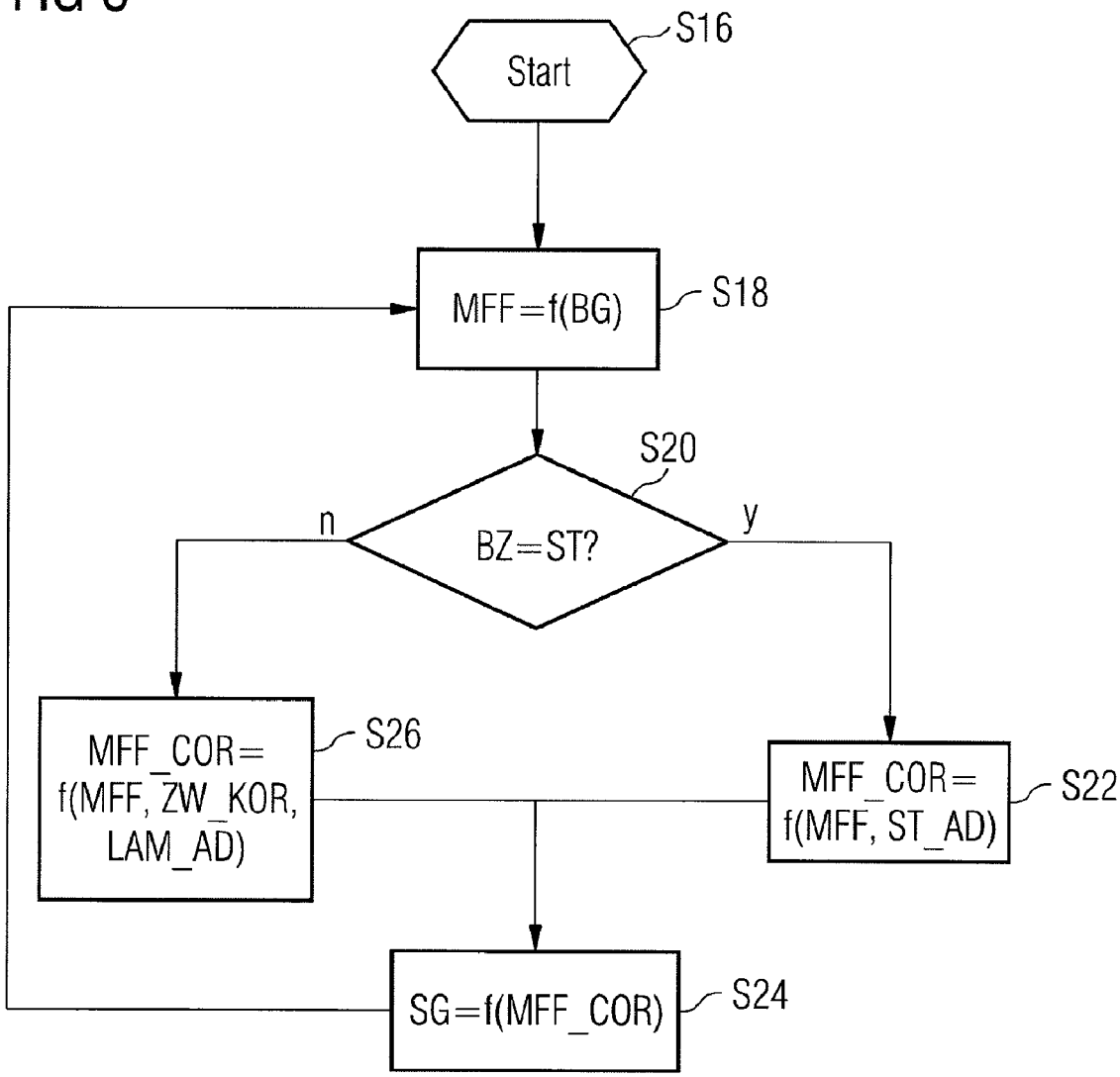

A further program according to the sequence diagram of FIG. 6 is started in a step S16, namely preferably directly upon the start of the internal combustion engine. In the step S16 variables may be initialized.

In a step S18 the fuel mass MFF to be metered is determined, namely in particular as a function of at least one operating variable BG, which may be for example the rotational speed N and/or the load variable LOAD. The load variable LOAD may represent for example the air flow or the intake manifold pressure.

The step S18 in terms of its design specification corresponds preferably to the block B20.

In a step S20 it is checked whether the current operating state BZ is the start ST. If so, the corrected fuel mass MFF_COR to be metered is determined as a function of the start quantity adaptation value ST_AD and as a function of the fuel mass MFF to be metered.

During the start ST in the cold state of the internal combustion engine, because the lambda probe is not ready to operate and first has to reach a predetermined temperature before being ready to operate, the lambda controller is deactivated, i.e. the lambda control factor LAM_FAC_FB has a neutral value and hence for example has the value 1. By means of the start quantity adaptation value ST_AD it is therefore possible to take into account an influence of the respective current fuel quality. This may be subject to marked variations depending on which fuel is in the tank and may change markedly particularly after each refueling operation. The adapting of the start quantity adaptation value ST_AD in the step S6 in this case occurs preferably in such a way that, upon detection of least volatile fuels with low vapor pressures, an increase of the fuel mass MFF to be metered is effected. In this case, it has been demonstrated that the rotational speed gradient GRAD_N has a good correlation with the fuel quality.

In a step S24 the actuating signal SG for triggering the injection valve 18 is generated, the step S24 possibly being represented for example also by the block B20.

The execution is then continued in the step S18, possibly for example after a definable waiting period or after execution of a definable crankshaft angle.

If the condition of the step S20 is not met, i.e. the internal combustion engine is outside of the start ST, then the execution is continued in a step S26.

In the step S26 the fuel mass MFF to be metered is corrected as a function of the intermediate correction value ZW_KOR and the start quantity adaptation value LAM_AD. The execution is then continued in the step S24.

Owing to the nature of the correction according to the step S26 and the determination thus effected of the corrected fuel mass MFF_COR to be metered, in the period of time after the start ST and before a subsequent first adaptation of the lambda adaptation value LA_AD in the step S12 a corrected fuel mass MFF COR to be metered, which is necessary for low emission of noxious substances and/or desired smooth running, may be taken into account particularly effectively.

Since the adapting of the lambda adaptation value LAM_AD is linked to the fulfillment of the preset condition COND of the step S10, what may happen in principle is that such an adapting does not occur until a relatively long time after the end of the start of the internal combustion engine or possibly does not even occur at all throughout the running of the engine. By utilizing the information regarding the current fuel quality, which is represented by the variation of the start quantity adaptation value ST_AD since the last adaptation of the lambda adaptation value LAM_AD, it is possible even before the adaptation of the lambda adaptation value LAM_AD to take this current fuel quality into account, for example, in the case of the metered fuel mass.

By the resetting of the intermediate correction value ZW_KOR to a neutral value in the step S14, account is taken of the fact that with the adaptation of the lambda adaptation value LAM_AD in the step S12 the current fuel quality at that time is then taken precisely into consideration as a result of the adaptation as a function of the control parameter LAM_RP of the lambda controller. To this extent, the intermediate correction value ZW_KOR after execution of the step S14 and before a fresh execution of the step S8 does not influence the corrected fuel mass MFF_COR to be metered.

To this extent, the step S26 may also be embodied in such a way that after execution of the step S14 and before execution of the step S8 the corrected fuel mass MFF_COR to be metered is determined independently of the intermediate correction value ZW_KOR.

The step S26 may also be designed in such a way that with expiry of a predetermined period of time and/or attainment of a predetermined temperature after the respective start ST the correction with the intermediate correction value ZW_KOR is returned by means of a ramp function over time to a neutral value.

Method as claimed in one of the preceding claims, in which with expiry of a predetermined period of time and/or attainment of a predetermined temperature after the respective start (ST) the correction with the intermediate correction value (ZW_KOR) is returned by means of a ramp function over time to a neutral value.

By virtue of the procedure according to the step S26 it may be guaranteed that mixture dilutions of the air-fuel mixture despite a change of fuel to cold-start-critical fuel and subsequent cold starting of the engine do not lead during subsequent operation to critical mixture dilutions.

The lambda adaptation value LAM_AD is preferably predetermined in each case separately for different temperature ranges and for these is preferably also adapted separately. In this case too, the resetting of the intermediate correction value ZW_KOR occurs in the step S14, namely when for at least one temperature range the respective lambda adaptation value LAM_AD was adapted for the first time after the respective start ST in the step S12. Preferably the respective temperature ranges in this case are for example representative of the coolant temperature.

What is claimed is:

1. A device for operating an internal combustion engine comprising at least one cylinder (Z1-Z4) with a combustion chamber, an injection valve (18) that is provided for metering fuel, a lambda controller being provided, the device being designed to adapt a start quantity adaptation value (ST_AD) as a function of a variable that is characteristic of a rotational speed profile during the start (ST) of the internal combustion engine, to adapt a lambda adaptation value (LAM_AD) as a function of at least one control parameter (LAM_RP) of the lambda controller if a preset condition (COND) is met, which presupposes the existence of a quasi-stationary operating state, to adapt an intermediate correction value (ZW_KOR) as a function of a change of the start quantity adaptation value (ST_AD) since a last adaptation of the lambda adaptation value (LAM_AD), to determine a fuel mass (MFF) to be metered as a function of at least one operating variable (BG) of the internal combustion engine, to correct the fuel mass (MFF) to be metered during the start (ST) of the internal combustion engine by means of the start quantity adaptation value (ST_AD), to correct the fuel mass (MFF) to be metered outside of the start (ST) of the internal combustion engine as a function of the lambda adaptation value (LAM_AD) and to correct the fuel mass (MFF) to be metered as a function of the intermediate correction value (ZW_KOR) until for the first time after the respective start (ST) the lambda adaptation value (LAM_AD) is adapted.

2. A method of operating an internal combustion engine comprising at least one cylinder (Z1-Z4) with a combustion chamber, an injection valve (18) that is provided for metering fuel, a lambda controller being provided, comprising:

adapting a start quantity adaptation value (ST_AD) as a function of a variable that is characteristic of a rotational speed profile during the start (ST) of the internal combustion engine, adapting a lambda adaptation value (LAM_AD) as a function of at least one control parameter (LAM_RP) of the lambda controller if a preset condition (COND) is met, which presupposes the existence of a quasi-stationary operating state, adapting an intermediate correction value (ZW_KOR) as a function of a change of the start quantity adaptation value (ST_AD) since a last adaptation of the lambda adaptation value (LAM_AD), determining a fuel mass (MFF) to be metered as a function of at least one operating variable (BG) of the internal combustion engine, correcting the fuel mass (MFF) to be metered during the start (ST) of the internal combustion engine by means of the start quantity adaptation value (ST_AD), correcting the fuel mass (MFF) to be metered outside of the start (ST) of the internal combustion engine as a function of the lambda adaptation value (LAM_AD), and correcting the fuel mass (MFF) to be metered as a function of the intermediate correction value (ZW_KOR) until for the first time after the respective start (ST) the lambda adaptation value (LAM_AD) is adapted.

3. The method as claimed in claim 2, wherein the adapting of the intermediate correction value (ZW_KOR) is carried out in such a way that a variation of the start quantity adaptation value (ST_AD) has a relatively smaller effect upon a variation of the start quantity adaptation value (ST_AD).

4. The method as claimed in one of the preceding claims, wherein the adapting of the intermediate correction value (ZW_AD) is carried out only if the change of the start quantity adaptation value (ST_AD) since the last adaptation of the lambda adaptation value (LAM_AD) exceeds a preset threshold value (THD).

5. The method as claimed in one of the preceding claims, wherein with the expiry of a preset period and/or attainment of a preset temperature after the respective start (ST) the correcting with the intermediate correction value (ZW_KOR) is returned by means of a ramp function over time to a neutral value.

6. The method as claimed in one of the preceding claims, wherein the preset condition (COND) is dependent upon a rotational speed (N) and/or a load variable (LOAD).

* * * * *